United States Patent [19]

DuVall

[11] Patent Number: 4,999,856

[45] Date of Patent: Mar. 19, 1991

[54] FACEMASK PROTECTION DEVICE

[76] Inventor: John F. DuVall, 5751 S. Kingston Way, Englewood, Colo. 80111

[21] Appl. No.: 493,287

[22] Filed: Mar. 14, 1990

[51] Int. Cl.[5] ..... A42B 3/04; A42B 3/18

[52] U.S. Cl. ..... 2/424; 2/425; 2/10; 2/9

[58] Field of Search ..... 2/410, 424, 425, 9, 2/10

[56] References Cited

U.S. PATENT DOCUMENTS

| | | | |
|---|---|---|---|
| 2,525,389 | 10/1950 | Zeller | 2/9 |
| 3,751,728 | 8/1973 | Thompkins | 2/3 R |
| 3,897,597 | 8/1975 | Kasper | 2/9 |
| 4,021,858 | 5/1977 | Neeld et al. | 2/9 |
| 4,028,743 | 6/1977 | Christensen | 2/424 |
| 4,031,564 | 6/1977 | Wood | 2/9 |
| 4,370,759 | 2/1983 | Zide | 2/424 |
| 4,446,576 | 5/1984 | Hisataka | 2/425 |
| 4,594,737 | 6/1986 | Butash | 2/424 |
| 4,689,835 | 9/1987 | Draft et al. | 2/424 |
| 4,736,466 | 4/1988 | Kallstrom | 2/9 |
| 4,825,878 | 5/1989 | Kuntz et al. | 128/857 |

*Primary Examiner*—Werner H. Schroeder
*Assistant Examiner*—Michael A. Neas
*Attorney, Agent, or Firm*—Richards, Medlock & Andrews

[57] ABSTRACT

A plastic body impregnated with a friction-reducing additive especially formed for insertion into a helmet and attachment to the inside of the horizontal faceguard bars of the helmet. A specially formed insert presents an anatomically curved rear surface which reduces the ability of an opposing player to grasp the facemask. This grasp-releasing function is further facilitated by the friction-reducing additive which reduces the surface coefficient of friction on the anatomically curved rear surface of the insert.

10 Claims, 2 Drawing Sheets

FIG. 1
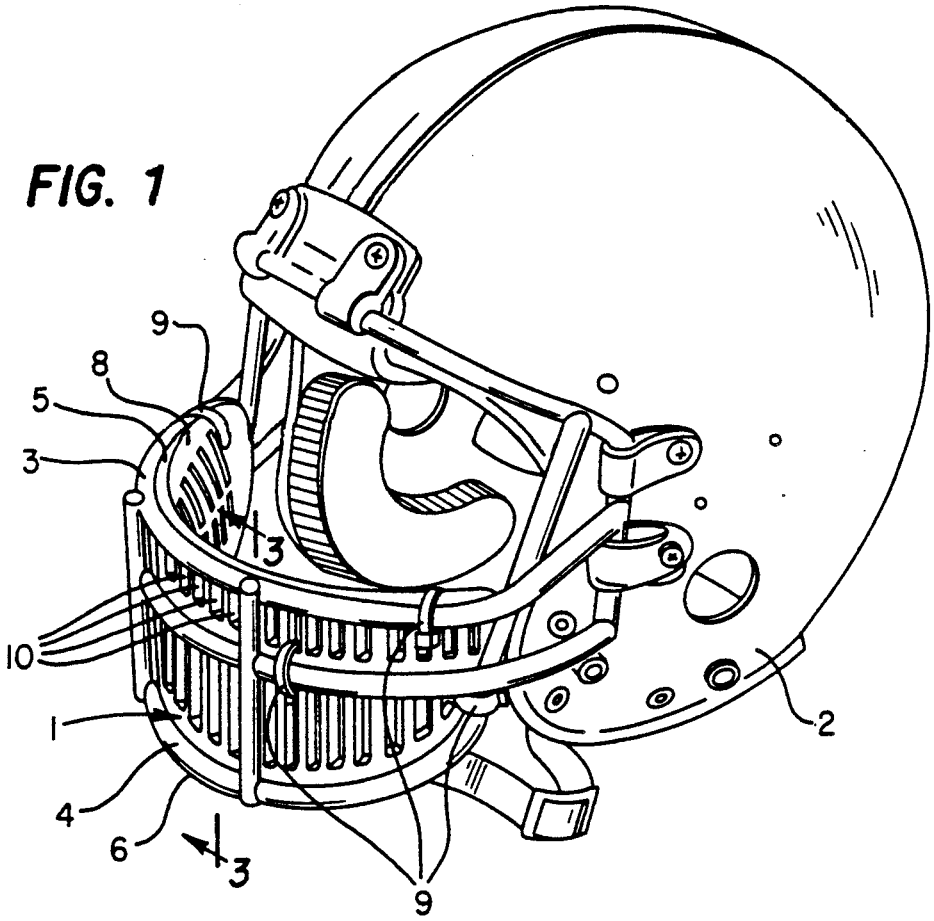
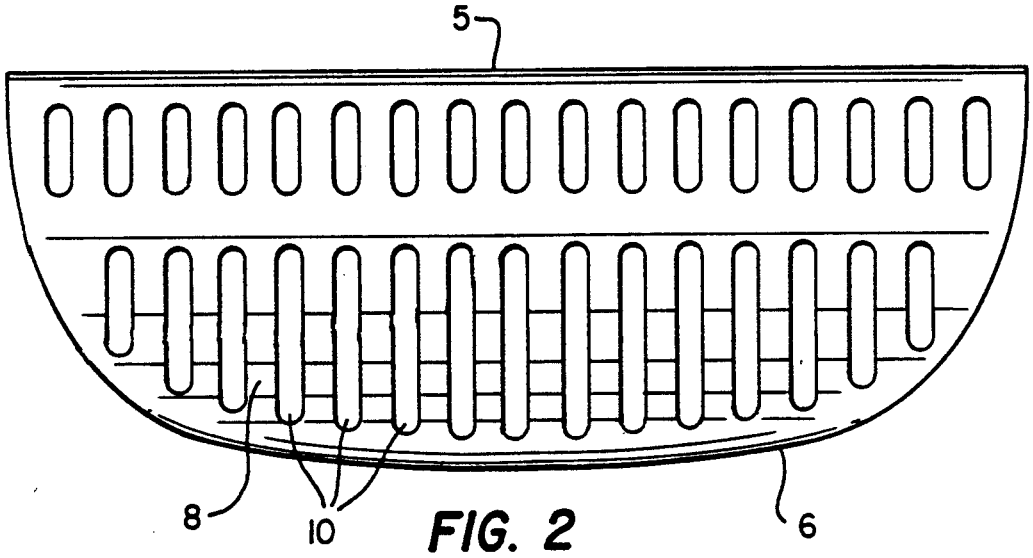
FIG. 2

FACEMASK PROTECTION DEVICE

TECHNICAL FIELD OF THE INVENTION

This invention relates in general to a deformable plastic insert for football helmet faceguards which prevents various injuries to the neck and face by reducing the ability of an opposing player to grasp the faceguard of a player's helmet.

BACKGROUND OF THE INVENTION

Various types of protective headgear have been designed for use in sporting activities. Some of these prior apparatus protect against physical impact to the head as well as against penetration of foreign objects into the face area of the helmet. Other of the apparatus provide a shock absorbing means for minimizing the impact of forceful blows to the faceguard. Although many of the headgear designs which utilize a protective shield to cover the entirety of the player's face would prevent an opposing player from grasping the facemask by virtue of preventing the penetration of the opposing player's hand into the upper part of the helmet, such designs have one or more serious disadvantages which severely limit their effectiveness. In particular, such full-face deflection shields cannot be adequately ventilated, can visually impair the player because of "fogging" of the shield, and can also impair verbal communication because of the physical blockage presented by the shield.

Over the past thirty years, several attempts were made to develop a device or system to reduce or eliminate facemask-related injuries. These devices primarily utilized some type of mechanism or retention device which allowed the faceguard to totally disengage from the helmet when a sufficient load or tension was applied. This type of approach was not acceptable to the game because of risk of further injuries when the faceguard separated from the helmet. The consensus of experts in the field is that the helmet and faceguard must remain intact at all times as a mutually supporting system. Any device which has the purpose of eliminating or reducing a firm grasp on the faceguard must not alter the structural integrity of the helmet/faceguard system.

It is therefore an objective of the present invention to provide a facemask protection device to prevent injury to the neck and face of a player by reducing the ability of an opposing player to grasp the facemask or to penetrate the facemask of a player's helmet. It is also an objective of the present invention to reduce injuries related to faceguard grasping while maintaining the structural integrity of the helmet/faceguard system. It is still further an objective of the present invention to reduce injuries to the lower facial area by eliminating thrusts of fingers through openings of the current faceguard designs.

SUMMARY OF THE INVENTION

The invention provides for a deformable plastic insert which is attached to the inside of a helmet against the faceguard bars. The plastic body or insert is specially formed such that, when properly attached to the upper horizontal faceguard bar, a curved, continuous surface is formed from the adjoinment of the plastic insert to the upper horizontal faceguard bar. This curved, continuous surface has a thickness substantially greater than the thickness of the upper horizontal faceguard bar, thus presenting a surface which is more difficult for opposing players to grasp, thereby facilitating hand release because the opposing player can no longer wrap his fingers around the upper horizontal faceguard bar. In addition, the plastic insert is impregnated with a friction-reducing additive which reduces the surface coefficient of friction on the curved rear surface of the plastic body or insert, thereby further facilitating hand release from the facemask or faceguard bars. Apertures are formed in the plastic body or insert to allow the player to breath and orally communicate, but are of sufficiently small size to prevent penetration therethrough by foreign objects, such as fingers. The plastic insert or body is attached to the inside of the horizontal faceguard bars to form a slippery deflection shield which reduces the ability of an opposing player to grasp the faceguard bars by creating a thicker grasping surface which has the reduced coefficient of friction and by impeding the penetration of fingers through the faceguard bars.

BRIEF DESCRIPTION OF THE DRAWINGS

For a more complete understanding of the present invention and the advantages thereof, reference is made to the following description of the accompanying drawings in which:

FIG. 1 shows a plastic insert installed into a football helmet in accordance with the present invention;

FIG. 2 shows the curved rear surface of the plastic insert in an embodiment of the present invention;

DETAILED DESCRIPTION OF THE INVENTION

Figure 3:
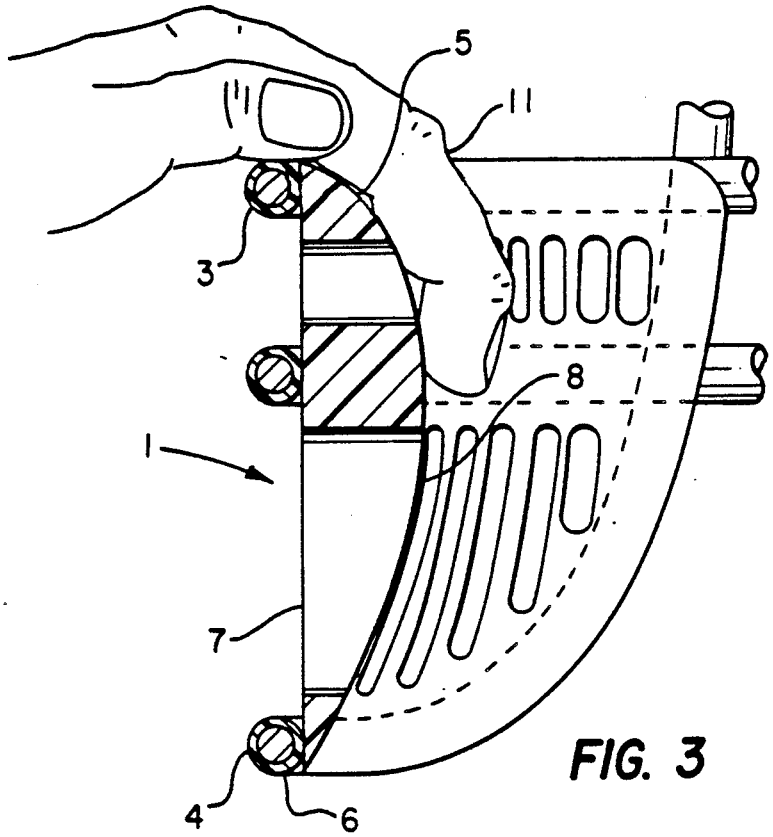
FIG. 3 shows a cross-section view of a hand attempting to grasp the plastic insert shown in FIG. 1 along the lines indicated by the number 3'.

With reference to the drawings, there is depicted a novel facemask protection device for insertion into and attachment to a football helmet for preventing various injuries to the neck and face by reducing the ability of an opposing player to grasp the faceguard of a player's helmet.

FIG. 1 shows the football helmet facemask protection system of the preferred embodiment of the present invention with the specially formed plastic body 1 being inserted into the helmet 2 and attached to the upper and lower horizontal faceguard bars 3, 4 by means of plastic connector elements 9. As can be appreciated, the plastic insert 1 must be sufficiently flexible to permit attachment to the faceguard bars.

FIG. 2 shows the anatomically curved rear surface 8 of the plastic insert 1 of an embodiment of the present invention. After insertion of the plastic insert 1 into the helmet 2, the plastic insert 1 acts as a deflection shield against penetration of fingers through the faceguard bars because of the small size of the apertures 10. In addition, the plastic insert 1 is specially molded so that an anatomically curved rear surface 8 is formed to approximate the natural curvature of the hand in its resting position. By connecting the plastic insert 1 to the faceguard bars 3, 4 so that the flat front surface 7 is attached to the upper and lower horizontal faceguard bars 3, 4 and the upper edge 5 is adjacent to and level with the upper horizontal faceguard bar 3 as shown in FIG. 1, the anatomically curved rear surface 8, the upper edge 5 and the upper horizontal faceguard bar 3 combine to form a curved, continuous grasping surface which is substantially thicker than the upper horizontal faceguard bar 3. The thickness of the curved, continuous surface prevents an opposing player from wrapping his fingers around the upper horizontal faceguard bar 3.

The plastic body 1 is formed of a slab of suitably deformable plastic material, such as polyurethane, polyethylene, polypropylene or urethane. In the preferred embodiment of the present invention, the deformable plastic insert 1 is formed of 90 Shore A polyurethane. As noted above, the plastic insert 1 must be suitably flexible so that the insert 1 can be fitted to the faceguard bars as shown in FIG. 1.

In FIG. 3, a cross section view of the plastic insert 1 as properly attached to the upper and lower faceguard bars 3, 4 is shown with the depiction of an opposing player's hand 11 as it attempts to grasp the facemask protection system. The opposing player's fingers are unable to wrap around the upper horizontal faceguard bar 3 because of the surface presented by the combination of the upper horizontal bar 3, the upper edge 5, and the anatomically curved rear surface 8. As is shown in FIG. 3, the thickness of the curved, continuous surface formed from the adjoinment of the upper horizontal bar 3 and the insert 1 is substantially greater than the thickness of the upper horizontal bar 3 alone. As will be appreciated, the grasp-releasing function of the curved, continuous surface can just as effectively be realized if the upper horizontal faceguard bar 3 and insert 1 adjoin to form a substantially continuous, curved surface (i.e., if there is a slight cleavage between the insert and faceguard bar).

In a preferred embodiment of the present invention, the plastic insert 1 is D-shaped so that the flat upper edge 5 will adjoin to the upper horizontal faceguard bar 3 across its entire length. It is preferred that the upper edge 5 match up with the upper horizontal faceguard bar 3 across its entire length so that grasp release is facilitated, no matter where the opposing player grabs the upper horizontal faceguard bar 3. It is further important that the plastic insert 1 be of sufficient thickness near the upper horizontal faceguard bar 3 so that the grasp release function is maximized.

In addition to providing a plastic insert whose physical dimensions reduce the ability of an opposing player to grasp the facemask, the present invention also incorporates a friction-reducing additive for reducing the surface coefficient of friction on the curved rear surface 8 of the plastic insert 1. Although any of a number of materials could be used, the preferred embodiment of the present invention utilizes a liquid silicone as the friction-reducing additive. In the preferred embodiment of the present invention, 1–3% by weight of liquid silicone is added to the polyurethane material prior to the molding of the plastic insert. This mixture creates a surface coefficient of friction roughly equivalent to that of a Teflon material. Although these parameters are not critical, they are preferred so as to retain the flexibility of the insert necessary for attachment thereof to the faceguard bars. The liquid silicone is preferred as an additive because it does not have the toxicity problems or mechanical weaknesses associated with other additives. The surface coefficient of friction for the plastic insert 1 can further be reduced by polishing the molding surface which is used to form the plastic insert 1.

After impregnation with the liquid silicone, the resulting plastic insert has a dry release with no greasy or sticky residue being transferred to a hand which makes contact with the insert. This is important so that ball control will not be affected, as would be the case if a residue were formed.

Figure 4A:
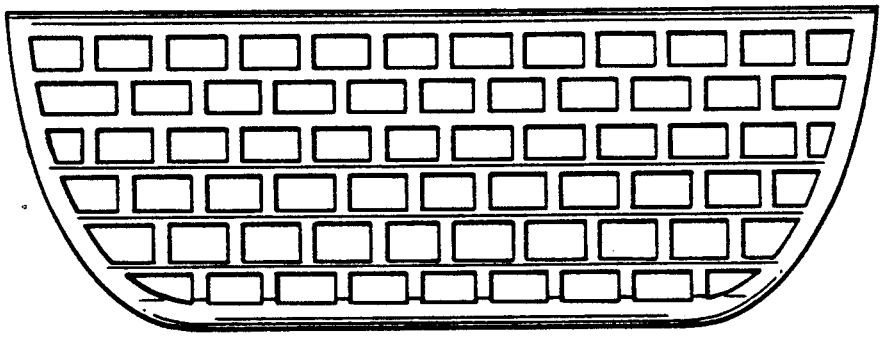
FIGS. 4*a* and 4*b* show additional embodiments of the plastic insert in accordance with the present invention.
Figure 4B:
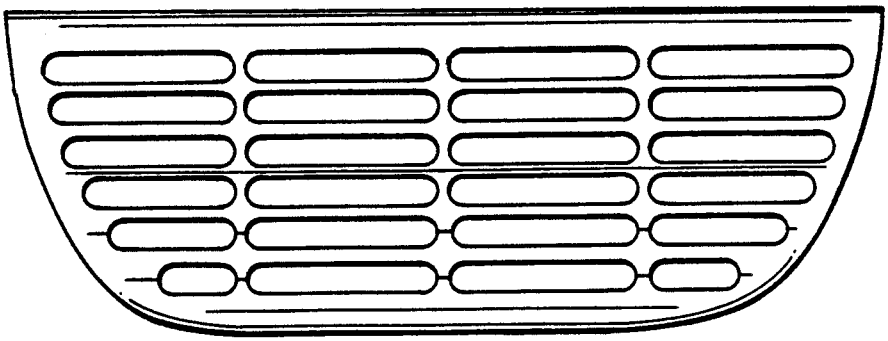

As shown in FIG. 2, vertical apertures 10 are formed in the plastic insert 1 to enable the player to speak, breathe, and see. These holes or slots are sufficiently small so as to prevent the thrusting of fingers therethrough, thereby preventing injuries to the lower face region. These apertures further prevent the ability of an opposing player to grasp the faceguard bars of a helmet. In the preferred embodiment of the present invention, horizontal slots or apertures are utilized because of the enhanced visibility which they provide the player. As shown in FIG. 2, FIG. 4*a* and FIG. 4*b*, there are a number of aperture designs which will accomplish the purpose of the present invention.

The plastic insert can be permanently attached to the faceguard bars by connection means known to those skilled in the art, or it can be removably attached by such connection means as plastic ties, VELCRO strips, snaps or other suitable connectors.

The plastic insert set forth as the preferred embodiment of the present invention will fit the Schutt model OPORS helmet which is an adult-sized faceguard and is the most popular design used by football players in skilled positions. Modifications of the present invention to fit other models of helmets or to fit helmets used by junior players are contemplated as being within the scope of the present invention.

In summary, there has been disclosed a specially curved plastic insert which is attached to the inside surface of the faceguard bars of a helmet and which is impregnated with a friction-reducing additive for reducing the surface coefficient of friction on the plastic insert. Although one embodiment of the invention has been illustrated in the accompanying drawings and described in the foregoing detailed description, it will be understood that the invention is not limited to the embodiment disclosed, but is capable of numerous rearrangements, modifications and substitutions, without departing from the scope of the invention.

I claim:

1. A facemask protection device for a helmet having an upper and lower horizontal faceguard bar, comprising:

a specially formed plastic body having an upper edge, a lower edge, a flat front surface, and a curved rear surface, said specially formed plastic body containing a friction-reducing additive to reduce the surface coefficient of friction on the curved rear surface, said upper edge being formed to fit within and snugly against the upper horizontal faceguard bar of the helmet such that the curved rear surface, upper edge, and upper horizontal faceguard bar adgoin to form a substantially continuous, curved surface of substantially greater thickness than the upper horizontal faceguard bar, and said plastic body being fixedly attached within and to the horizontal faceguard bars such that the upper edge is fixed adjacent to the upper horizontal faceguard bar, the lower edge is fixed to the lower horizontal faceguard bar, and the flat front surface is fixed within and to the upper and lower horizontal faceguard bars.

2. The facemask protection device of claim 1 wherein the plastic body has formed therein a number of apertures of sufficient size to enable a player to speak, breathe and see through the plastic body without allowing penetration of foreign objects.

3. The facemask protection device of claim 1 wherein the plastic body is made of one of the materials from the following group: polyurethane, 90 Shore A polyurethane, polyethylene, polypropylene or urethane.

4. The facemask protection device of claim 1 wherein the plastic body is impregnated with friction-reducing additive.

5. The facemask protection device as described in claim 4 wherein the friction-reducing additive is liquid silicone.

6. A football helmet facemask protection system comprising:

a football helmet having an upper and lower horizontal faceguard bar, a specially formed plastic insert for insertion into the helmet and connection with the upper and lower horizontal faceguard bars, and a connection means for attaching the plastic insert to the upper and lower horizontal faceguard bars, said plastic insert having an upper edge, a flat front surface, and a curved rear surface, and being impregnated with a friction-reducing additive for reducing the surface coefficient of friction on the curved rear surface, and said connection means adjoining the upper edge to the upper horizontal faceguard bar and the flat front surface to the upper and lower horizontal faceguard bars so that the curved rear surface, upper edge. and upper horizontal bar adjoin to form a continuous, curved surface of substantially greater thickness than the upper horizontal faceguard bar.

7. The football helmet facemask protection system of claim 6 wherein the connection means permits the removable attachment of the plastic insert to the football helmet.

8. The football helmet facemask protection system of claim 6 wherein the plastic insert has a plurality of apertures formed therein which are sufficiently small to prevent the penetration of foreign objects.

9. The football helmet face protection system of claim 6 wherein the plastic insert is formed of 90 Shore A polyurethane and the friction-reducing additive is liquid silicone.

10. A specially formed polyurethane deflection shield for insertion and connection to a helmet, comprising:

a D-shaped slab of deformable polyurethane material having a flat upper edge, a curved lower edge, a flat front surface, and a curved rear surface, said slab being impregnated with a friction-reducing additive for reducing the coefficient of friction on the curved rear surface, and said slab further having formed therein a plurality of apertures to facilitate breathing and verbal communication, but being sufficiently small to prevent penetration of foreign objects.

* * * * *